US005809593A

United States Patent [19]

Edwards

[11] Patent Number: 5,809,593

[45] Date of Patent: Sep. 22, 1998

[54] MATTRESS COVER WITH WIDE ELASTIC STRIP

[75] Inventor: Craig Edwards, Arlington, Tex.

[73] Assignee: Hollander Home Fashions Corp., Boca Raton, Fla.

[21] Appl. No.: 827,786

[22] Filed: Apr. 11, 1997

[51] Int. Cl.[6] ..... A47G 9/04

[52] U.S. Cl. ..... 5/497; 5/499; 5/482; 40/299.1

[58] Field of Search ..... 5/497, 499, 482, 5/500, 495, 496, 498, 502; 40/299.01

[56] References Cited

U.S. PATENT DOCUMENTS

| | | | |
|---|---|---|---|
| 2,162,755 | 6/1939 | Shauer . | |
| 2,214,074 | 9/1940 | Clarke . | |
| 2,528,313 | 10/1950 | Kessler . | |
| 2,569,627 | 10/1951 | Black . | |
| 2,624,893 | 1/1953 | Harris . | |
| 2,639,444 | 5/1953 | De Monsabert . | |
| 2,662,234 | 12/1953 | Citron . | |
| 2,856,615 | 10/1958 | Cirocco . | |
| 2,857,643 | 10/1958 | Tomsic . | |
| 2,942,280 | 6/1960 | May, Jr. . | |
| 3,020,566 | 2/1962 | Anderson et al. . | |
| 3,114,156 | 12/1963 | Cobb . | |
| 3,150,621 | 9/1964 | Warnock . | |
| 3,273,175 | 9/1966 | Anderson et al. . | |
| 3,789,441 | 2/1974 | Weiss . | |
| 4,370,939 | 2/1983 | Fontcuberta | 112/262.2 |
| 4,461,049 | 7/1984 | Hammond | 5/498 |
| 4,672,702 | 6/1987 | Isham | 5/497 |
| 4,682,555 | 7/1987 | Bierbaum et al. | 112/262.1 |
| 4,703,530 | 11/1987 | Gusman | 5/497 |
| 4,727,608 | 3/1988 | Joyce | 5/497 |
| 4,768,252 | 9/1988 | Ross | 5/497 |
| 4,825,489 | 5/1989 | Ross | 5/497 |
| 4,899,408 | 2/1990 | Illingworth | 5/497 |
| 4,903,357 | 2/1990 | Kruchen et al. | 5/482 |
| 4,937,904 | 7/1990 | Ross | 5/497 |
| 4,962,546 | 10/1990 | Vital | 5/497 |
| 5,249,322 | 10/1993 | Seago | 5/499 |
| 5,325,555 | 7/1994 | Whitley | 5/497 |
| 5,479,664 | 1/1996 | Hollander | 5/499 |
| 5,530,979 | 7/1996 | Whitley | 5/497 |
| 5,636,393 | 6/1997 | Zafiroglu et al. | 5/497 |

FOREIGN PATENT DOCUMENTS

| | | | |
|---|---|---|---|
| 0425466 | 5/1991 | European Pat. Off. | 5/497 |

*Primary Examiner*—Alexander Grosz
*Attorney, Agent, or Firm*—Lerner, David, Littenberg, Krumholz & Mentlik

[57] ABSTRACT

A mattress cover includes a top panel, a skirt portion depending from the periphery of the top panel, and an elastic strip connected to the free edge of the skirt portion. The elastic strip has a width of between about 0.75" and about 3.0" so as to produce a strong elastic force holding the mattress cover in close conforming relationship on mattresses within a wide range of thicknesses. The elastic strip is sufficiently wide that ornamentation, including trademarks, logos and other symbols applied thereto, would be readily discernible when the mattress cover is not in use, but would not be plainly visible when the mattress cover is in use and therefore would not interfere with the aesthetic appearance of the bed.

11 Claims, 1 Drawing Sheet

MATTRESS COVER WITH WIDE ELASTIC STRIP

FIELD OF THE INVENTION

The present invention relates to mattress covers and, more particularly, to a mattress cover capable of accommodating mattresses having a variety of different thicknesses or depths. Still more particularly, the present invention is directed to a mattress cover which will fit snugly on mattresses of various thicknesses without unintentionally slipping off.

BACKGROUND OF THE INVENTION

Mattresses today are available in a wide variety of sizes and styles. Among the most popular sizes are twin, queen and king. Although the mattresses in each of these size groups have more or less the same nominal length and width dimensions, the thickness or depth dimension of the mattresses often differs substantially among mattresses within the same size group based upon such factors as the construction of the mattresses, their style, the amount of padding, etc. For example, mattresses within the same size group can range in thickness from about 5 inches to about 15 inches.

In view of the large range of thicknesses in which mattresses are available, it is difficult to make a mattress cover which will fit snugly on all of the mattresses within a given size group. For example, a conventional mattress cover typically includes a quilted panel which rests on top of the mattress, and a woven fabric skirt depending from the periphery of the quilted panel. An elastic cord about ¼ inch in width is attached along the free edge of the skirt, and is intended to fit under the mattress to hold the mattress cover in place. Mattress covers of this type typically fit poorly on thin mattresses so that, even with extensive tucking, such mattress covers sag, wrinkle and hang loosely when in use, such that the mattress cover often slips relative to the mattress. At the other extreme, these conventional mattress covers frequently will have a skirt portion which is not sufficiently deep to reach below mattresses which are relatively thick, and therefore will frequently slip off of these mattresses.

To address the foregoing problems, a wide array of systems have been developed for securely holding mattress covers to mattresses within a wide range of thicknesses. These systems have met with little success, often introducing problems which did not exist with conventional mattress covers. For example, one style of mattress cover includes a quilted panel which rests on top of the mattress, with elastic anchor bands attached diagonally across each corner of the panel for engaging below the corners of the mattress. These mattress covers do not engage the mattress securely, and the anchor bands tend to pop off of the mattress easily.

Another style of mattress cover includes a quilted panel which rests on top of the mattress and a quilted elasticized skirt portion which engage the sides of the mattress. These mattress covers tend to be bulky, and the added thickness of the quilted skirt portion creates difficulties in installing fitted sheets properly thereover such that the fitted sheets easily pop off.

Yet a further style of mattress cover includes a quilted panel having a skirt formed from LYCRA elastic material depending from the periphery thereof. Although the LYCRA skirt is able to stretch to fit snugly on mattresses of different thicknesses, mattress covers having this construction are expensive to manufacture.

U.S. Pat. No. 5,249,322 to Seago discloses a fitted mattress cover having a top panel and a peripheral skirt formed from a fabric material with a multiplicity of parallel, spaced apart elastic cords stitched into the skirt fabric to gather the fabric into folds oriented perpendicular to the longitudinal axis of the elastic cords. Mattress covers having this construction involve complicated manufacturing techniques and are thus costly to produce.

U.S. Pat. No. 5,479,664 to Hollander is directed to a mattress cover having a top panel, a fabric skirt depending from the periphery of the top panel, a thin elastic strip along the free edge of the skirt, and a plurality of elastic strips interconnecting spaced apart portions of the free edge of the skirt for drawing those portions toward one another. The manufacture of mattress covers having this construction is labor intensive and, for that reason, these mattress covers are costly to produce.

A further drawback to prior art mattress covers has been that the placement of discernible indicia on the mattress covers has been visually objectionable. In this regard, any discernible indicia placed on either the top panel of the mattress cover or the skirt portion thereof would ordinarily be visible through a sheet placed over the mattress cover, and would therefore detract from the aesthetic appearance of the sheet. This problem has made it difficult for manufacturers and other businesses to place ornamentation, particularly their trademarks, logos or other symbols, on the mattress covers.

There thus exists a need for a mattress cover which is simple in construction and inexpensive to produce, yet which is capable of accommodating the wide range of mattress thicknesses within a given size group with a proper fit which is neither too loose so as to look sloppy, or too tight so as to easily slip off of the mattress. There also exists a need for a mattress cover to which ornamentation, including trademarks, logos and other symbols, can be applied without interfering with the aesthetic appearance of a sheet placed over the mattress cover.

SUMMARY OF THE INVENTION

The present invention addresses these needs by providing a mattress cover having a top panel sized and shaped for fitting in overlying relationship on the top surface of a mattress, and a skirt portion depending from a periphery of the top panel. The skirt portion preferably is made from a material which is not elastically stretchable, and includes an elastic strip connected to its free edge at a spaced distance from the top panel. The spaced distance between the top panel and the free edge of the skirt portion may be between about 12 inches and about 18 inches, preferably between about 14 inches and about 16 inches. The elastic strip may have a width of between about 0.75 inches and about 3.0 inches, preferably between about 1.0 inch and 2.0 inches, and most preferably about 1.5 inches, and may extend along substantially the entirety of the free edge of the skirt portion. Optionally, the strip may include ornamentation including source identifying indicia formed thereon.

BRIEF DESCRIPTION OF THE DRAWINGS

A more complete appreciation of the subject matter of the present invention and the various advantages thereof can be realized by reference to the following detailed description, in which reference is made to the accompanying drawings in which.

DETAILED DESCRIPTION OF THE PREFERRED EMBODIMENTS

Figure 1:
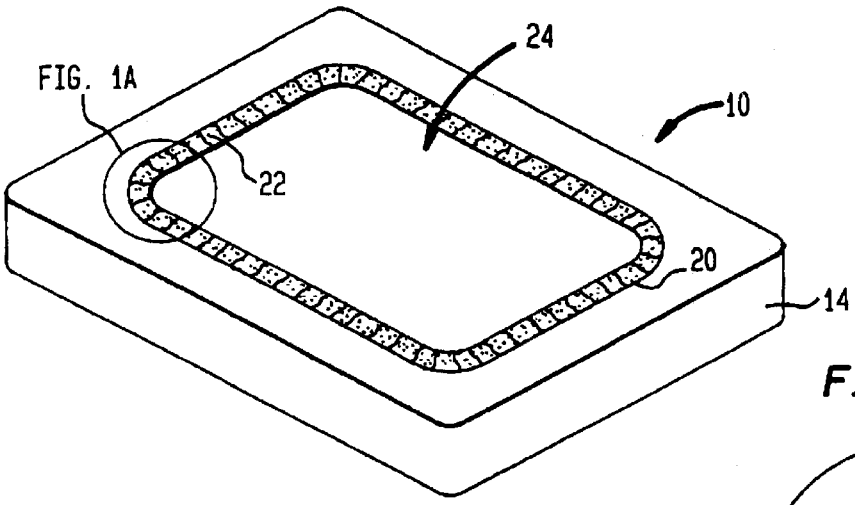
FIG. 1 is a bottom perspective view of a mattress cover in accordance with the present invention.
Figure 1A:
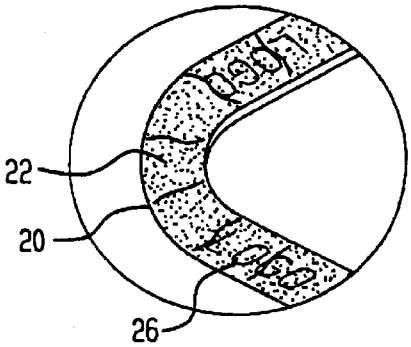
FIG. 1A is an enlarged detailed view showing the placement of ornamentation on the elastic strip of the mattress cover.

Referring to the figures, there is illustrated a preferred embodiment of a mattress cover 10 in accordance with the present invention. Mattress cover 10 includes a top panel 12 and a skirt portion 14 connected to top panel 12 along its periphery. Top panel 12 is configured to have a generally rectangular profile with length and width dimensions sufficient to overlay substantially the entire top surface of a mattress. Thus, for example, in a mattress cover for a king size mattress, top panel 12 may have a length of about 80 inches and a width of about 78 inches; in a mattress pad for a twin size mattress, top panel 12 may have a length of about 75 inches and a width of about 39 inches. Top panel 12 may be made from conventional fabric materials, such as cotton, polyester/cotton blends and the like, and may be padded, preferably with a quilted construction.

Skirt portion 14 is attached along one edge 18 to the peripheral edge of top panel 12, such as by sewing, stitching or the like, and extends therefrom to a free edge 20 remote from the top panel. Preferably, skirt portion 14 has a width between edges 18 and 20 of between about 12 inches and about 18 inches, and more preferably between about 14 inches and about 16 inches, so as to entirely cover the sides and ends of mattresses which are up to 15 inches thick or thicker. Skirt portion 14 may be made from a single piece of continuous fabric, without corners, so that, with mattress cover 10 assembled on a mattress, skirt portion 14 forms a continuous enclosure conforming around the side walls and end walls of the mattress. Conventional woven fabrics, such as cotton, polyester/cotton blends, nylon blends and the like, may be used to form skirt portion 14, as may non-woven materials, such as pressed nylon or polyester. Desirably, skirt portion 14 is made from a material which is not elastically stretchable.

Along its free edge 20, skirt portion 14 includes an elastic strip 22 which is significantly wider than the elastic strip used on conventional mattress covers. Thus, rather than the ¼ inch wide elastic strip employed on conventional mattress covers, elastic strip 22 has a width of between about 0.75 inch and about 3.0 inches, and preferably between about 1.0 inch and about 2.0 inches. A particularly preferred elastic strip in this regard is a 1.50 inch wide woven elastic strip sold by Zar Industry as Model PK100. Elastic strip 22 may be attached to the free edge 20 of skirt portion 14 by first gathering the material along free edge 20 and then joining elastic strip 22 to the gathered material by sewing, stitching or any other suitable means. In its relaxed state, elastic strip 22 defines an opening 24 in the bottom of mattress cover 10. The gathers permit elastic strip 22 to be stretched to expand the size of opening 24 for fitting mattress cover 10 over a mattress. As will be explained further below, when stretched to increase the size of opening 24, elastic strip 22 produces an elastic force tending to return opening 24 to its relaxed size which is greater than the elastic force produced by the elastic strip in conventional mattress covers.

In its use position on a mattress, the top panel 12 of mattress cover 10 is positioned so that it is substantially coextensive with the top surface of the mattress. Skirt portion 14 depends from top panel 12 to cover the side and end walls of the mattress, with its free edge 20 tucked below the mattress. In this position, elastic strip 22 draws the free edge 20 of skirt portion 14 together to reduce the size of opening 24. This action tends to pull the free edge of the skirt portion towards the center of the underside of the mattress so as to produce a snug fit of the skirt portion against the side and end walls of the mattress.

Figure 2:
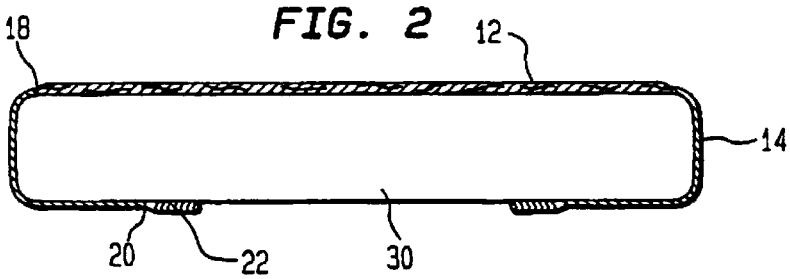
FIG. 2 is a cross-sectional view showing the application of the mattress cover of FIG. 1 to a relatively thin mattress.
Figure 3:
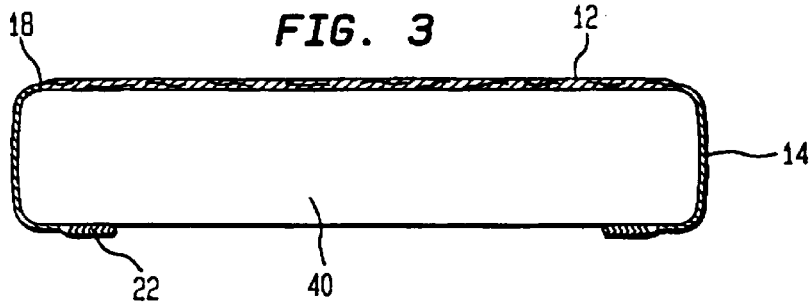
FIG. 3 is a cross-sectional view showing the application of the mattress cover of FIG. 1 to a relatively thick mattress.

The ability of the mattress cover of the present invention to fit mattresses within a wide range of thicknesses or depths is illustrated in FIGS. 2 and 3. FIG. 2 illustrates mattress cover 10 on a relatively thin mattress 30. As shown, mattress cover 10 envelopes mattress 30 with top panel 12 substantially coextensive with the top of the mattress and with skirt portion 14 surrounding the side and end walls of the mattress and extending to a substantial degree toward the center of the mattress so as to cover a major portion of the underside of the mattress.

FIG. 3 depicts a mattress 40 within the same size group as mattress 30 of FIG. 2, but having a thickness which is substantially greater than the thickness of mattress 30. As shown in the figure, when the same mattress cover 10 is applied to mattress 40, top panel 12 is still substantially coextensive with the top of the mattress and skirt portion 14 surrounds the side and end walls thereof. However, in the case of this thicker mattress, skirt portion 14 extends beneath the mattress to a much lesser extent so as to cover the bottom of the mattress only along its peripheral edge. Thus, regardless of the thickness or depth of the mattress to which mattress cover 10 is applied, elastic strip 22 will pull the skirt portion 14 thereof tightly against the side and end walls of the mattress to hold the mattress cover neatly and securely on the mattress.

As a result of its enlarged width, elastic strip 22 provides a surface to which may be applied ornamentation, including indicia identifying the source of the mattress cover. Thus, elastic strip 22 may include trademarks, logos or other symbols identifying the manufacturer or distributor of the mattress cover, or even an end user of the mattress cover, such as a hotel chain or other business entity. Since, in the use position of mattress cover 10, elastic strip 22 is intended to be positioned below the mattress, it will not be visible through a sheet overlying the mattress cover, and therefore will not be subject to the same objections as encountered when attempting to place such indicia on the top panel or skirt portion of the mattress cover.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as set forth in the appended claims.

I claim:

1. A cover for a mattress having a top surface, a bottom surface, a pair of end surfaces and a pair of side surfaces, said mattress cover comprising a top panel sized and shaped for fitting in overlying relationship on the top surface of the mattress;

a skirt portion depending from a periphery of said top panel and having a free edge at a spaced distance from said top panel;

an elastic strip having a first longitudinal edge connected to said free edge of said skirt portion and a free longitudinal edge spaced from said free edge of said skirt portion, said strip having a width between said first longitudinal edge and said free longitudinal edge of between about 0.75 inch and 3.0 inches.

2. A mattress cover as claimed in claim 1, wherein said strip has a width of between about 1.0 inch and about 2.0 inches.

3. A mattress cover as claimed in claim 2, wherein said strip has a width of about 1.5 inches.

4. A. A mattress cover as claimed in claim 1, wherein said strip extends along substantially the entirety of said free edge of said skirt portion.

5. A mattress cover as claimed in claim 1, wherein said strip includes ornamentation formed thereon.

6. A mattress cover as claimed in claim 5, wherein said ornamentation includes source identifying indicia.

7. A mattress cover as claimed in claim 1, wherein said spaced distance is between about 12 inches and about 18 inches.

8. A mattress cover as claimed in claim 7, wherein said spaced distance is between about 14 inches and about 16 inches.

9. A mattress cover as claimed in claim 1, wherein said top panel has a quilted construction.

10.A mattress cover as claimed in claim 1, wherein said skirt portion is formed from a material which is not elastically stretchable.

11. A mattress cover as claimed in claim 1, wherein said elastic strip is formed from a woven material.

* * * * *

UNITED STATES PATENT AND TRADEMARK OFFICE

CERTIFICATE OF CORRECTION

PATENT NO. : 5,809,593

DATED : September 22, 1998

INVENTOR(S) : Edwards

It is certified that error appears in the above-identified patent and that said Letters Patent is hereby corrected as shown below:

Column 5, line 10, delete "A."

Signed and Sealed this

Twenty-sixth Day of January, 1999

*Attest:*

*Attesting Officer*

*Acting Commissioner of Patents and Trademarks*